United States Patent [19]

Tambs

[11] Patent Number: 4,582,133

[45] Date of Patent: Apr. 15, 1986

[54] PIPE HANDLING ASSEMBLY

[75] Inventor: Erling Tambs, Kristiansand S, Norway

[73] Assignee: Maritime Hydraulics A.S., Kristiansand S, Norway

[21] Appl. No.: 614,220

[22] Filed: May 25, 1984

[30] Foreign Application Priority Data

Nov. 11, 1983 [NO] Norway ..... 834132

[51] Int. Cl.[4] ..... E21B 19/00; E21B 19/10

[52] U.S. Cl. ..... 166/77.5; 175/422 WS

[58] Field of Search ..... 166/77.5, 85, 78, 377, 166/381; 175/52, 422 W, 85, 161, 122, 203; 173/148, 149, 150, 151, 163-167; 188/67; 414/22; 294/86.3, 86.31, 86.2, 86.1, 86.12

[56] References Cited

U.S. PATENT DOCUMENTS

| | | | |
|---|---|---|---|
| 1,910,890 | 5/1933 | Fortune | 175/203 X |
| 3,399,735 | 9/1968 | Ikeda | 175/203 X |
| 3,633,767 | 1/1972 | Mitchell | 414/22 X |
| 3,919,902 | 11/1975 | Johnson | 175/85 X |
| 4,172,684 | 10/1979 | Jenkins | 414/22 X |
| 4,440,536 | 4/1984 | Scaggs | 414/22 X |

*Primary Examiner*—Stephen J. Novosad

*Assistant Examiner*—David J. Bagnell

*Attorney, Agent, or Firm*—Cushman, Darby & Cushman

[57] ABSTRACT

A pipe handling assembly in connection with an oil derrick comprises two pivotable and vertically movable arms having a grab head in the form of a U-shaped claw intended for transporting a stand of pipe, a drill collar or the like from the well center to a rack, and vice versa. The grab head on one arm, preferably the lower arm, is subdivided vertically into a lower U-shaped member fixedly connected to the arm via a housing and an upper U-shaped member rotatably relative to the lower member and provided with locking means for retaining the pipe, drill collar or the like. The two members are provided with rotation means intended to bring the upper, rotatable member from an arbitrary angular position into a locked position in which its claw aperture is in alignment with the claw aperture of the lower member. The rotation means which brings the two apertures into alignment, in a preferred embodiment, consists of the facing surfaces on the two members, which are formed as complementary, helical, inclined planes whose ends (entry and exit of the Helix) are connected via respective surfaces which form an acute angle relative to the centerline of the housing.

6 Claims, 7 Drawing Figures

PIPE HANDLING ASSEMBLY

Figure 1:
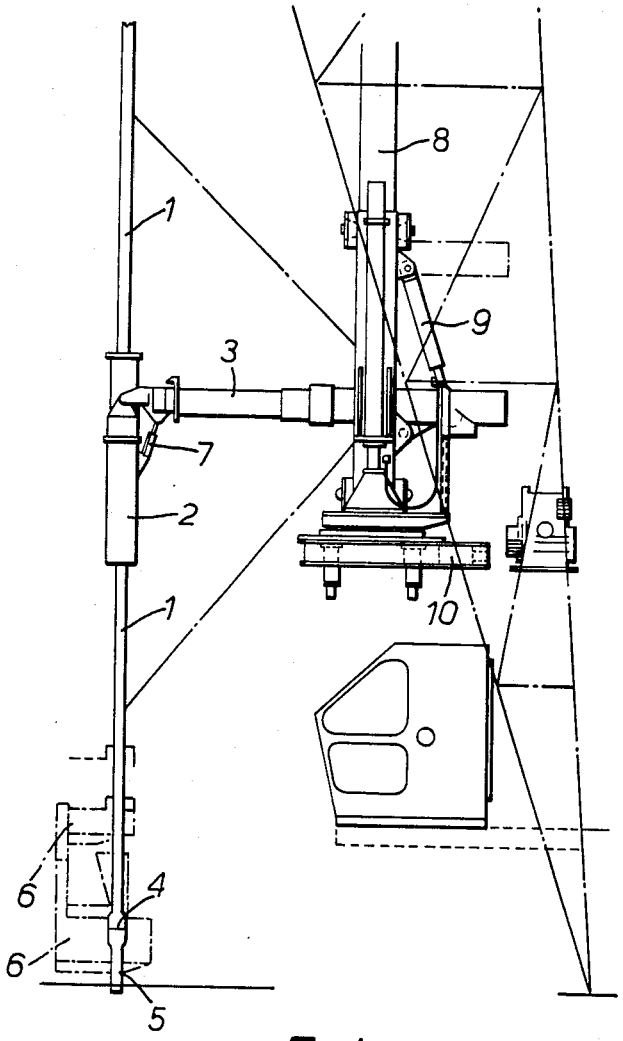

The present invention relates to a pipe handling assembly in connection with an oil derrick, comprising at least two pivotable, vertically movable arms carrying grab heads in the form of U-shaped claws, utilized for transferring lengths of pipe or the like from the well center to a pipe rack, and vice versa.

The drill pipe utilized during deep drilling for oil and gas consists of lengths of pipe that are joined together and can be detached from the drill string in a simple manner. The drill string must be hoisted up from the well at relatively frequent intervals for replacing the drill bit, checking the drilling direction, etc. Stands of pipe consisting of three lengths of pipe each about 10 meters long are consecutively disengaged from the upper end of the drill string and stored temporarily in racks.

The pipes are joined by a screw connection, and a stand of pipe is detached from the drill string by immobilizing the drill string and then gripping and retaining the stand of pipe in a device which rotates the pipe to unscrew the connection.

Earlier, this was done as the drill string hung suspended from the hoist hook on the derrick. A swivel was fastened to arms attached to the hook, and the swivel grasped the enlarged threaded section of the pipe. The hook or block was provided with a spring system for equalizing the weight of the stand of pipe that was being detached from the drill string, in order to avoid intolerable strains on the threads as the pipe was being screwed in or unscrewed. This practice was relatively time consuming since the derrick hook was in constant use during the unscrewing of the pipe, and it is no longer being followed. Newer methods involve a more automated handling system, wherein two or three arms hold and retain the pipe. The block with the hook is then freed and can be drawn aside and lowered on a path laterally parallel to the line of drilling, bringing the hook into position for grasping a new stand of pipe, while the arms transport the preceding stand of pipe to the pipe rack.

The drawback of this system is that the full weight of the stand of pipe rests on the screw threads when the pipe is being connected or disengaged. This naturally increases wear on the threads and may even cause permanent damage.

The object of the present invention is to provide a pipe handling assembly in which this drawback is avoided, thereby obtaining the advantages described below.

This object is obtained with an assembly of the type defined above which is characterized in that the grab head on one arm, preferably the lower arm, is subdivided vertically into a lower U-shaped member that is fixedly connected to the arm and an upper U-shaped member that is rotatable in relation to the fixed member and is provided with a locking means for retaining a pipe or the like, and in that the upper member is provided with a rotation means intended to bring the rotatable upper member from an arbitrary angular position into a locked position in which its claw aperture is aligned with the claw aperture on the lower member.

In a practical embodiment, the lower member is secured within a housing having a tubular jacket which is rigidly attached to the arm and which has a longitudinal slot constituting the passage of entry for the pipe or the like, the slot corresponding with the claw aperture on the lower member, and at each end of the housing, engaging/disengaging means are provided which prevent the pipe or the like held within the member from falling out and at the same center the pipe in the housing. Preferably, the retaining and centering means consists of two facing, pivotable flaps which are attached to the housing and pivotable about one end thereof by means of a power-driven actuator.

In a further development of the invention, the rotation means for the upper, rotatable member is formed by two facing surfaces on the respective U-shaped members which are formed as complementary, helical, oblique surfaces whose ends are connected via a surface which forms an acute angle relative to the centerline of the housing. An additional feature is that a plurality of lifting cylinders are provided between the upper and lower members which are adapted to lower the lower member's helical surface clear of the upper member's helical surface for permitting rotation of the upper member. In a further refinement of the invention, the upper member can be provided with its own rotary motor.

Another practical refinement of the invention is that the arm is provided with a spring means, preferably an adjustable gas/fluid spring system for compensating the weight of the pipe or the like which is suspended from the grab head on the arm. The grab head itself can be articulated to the arm, permitting it to be set at various angles relative to the vertical.

Figure 2:
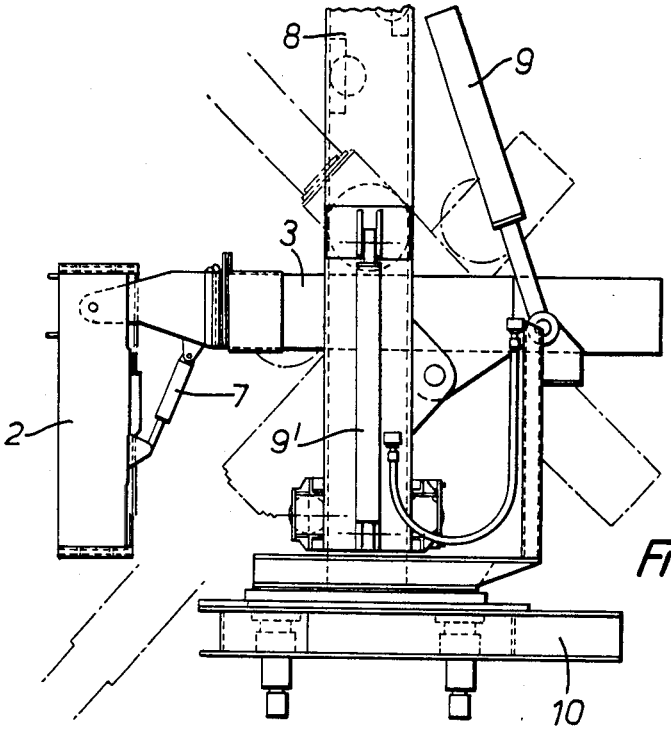
Figure 4A:
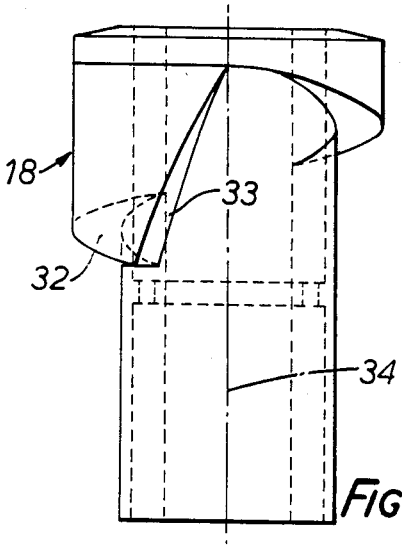
Figure 4B:
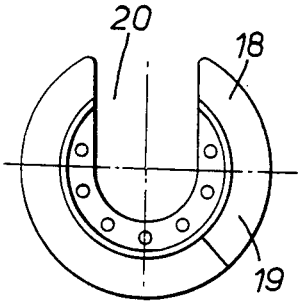
Figure 3:
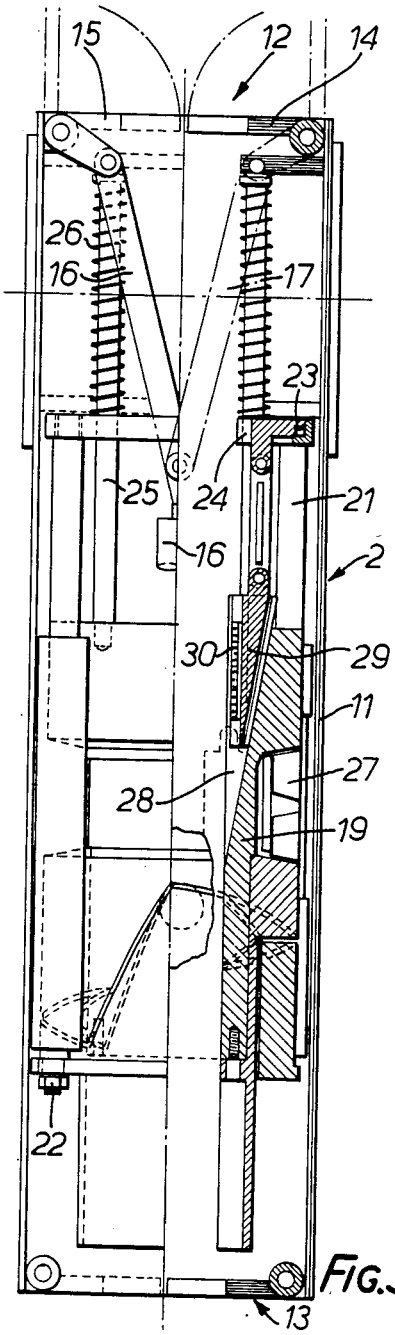
Figure 5:
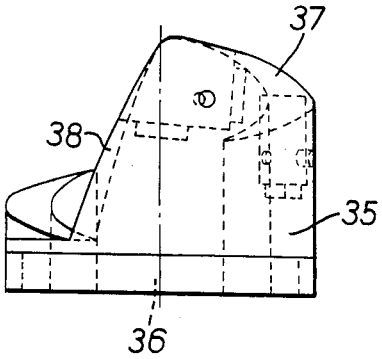
Figure 6:
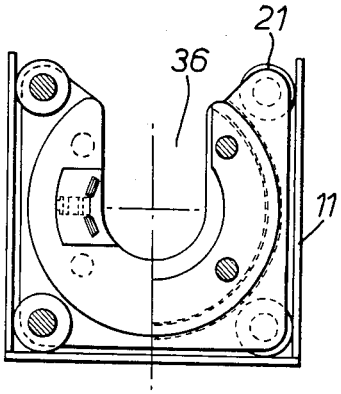

The invention will be explained in greater detail in the following with reference to the accompanying drawings, wherein:

FIG. 1 shows a pipe handling arm with a grab head, in accordance with the invention, FIG. 2 shows a detail of the assembly on a somewhat larger scale, FIG. 3 is a schematic cross section through a grab head according to the invention, FIGS. 4*a*, 4*b* show details of the upper, rotatable member on the grabber, FIG. 5 shows the lower, fixed member, and FIG. 6 shows a bottom view of FIG. 3 in horizontal section.

FIG. 1 shows a stand of drill pipe 1 held in a grab head 2 in accordance with the invention, which is attached to a telescoping arm 3. The pipe, which may consist of three joined lengths of pipe each 10 meters long, is connected at the coupling 4 to the rest of the drill string 5. In addition to handling drill pipe, the assembly can also be used for handling drill collars. The grab head must in that case be replaced by a head of larger dimensions. The pipe 1 is disengaged from the drill string with the aid of the device indicated generally by numeral 6. The drill string is held immobile at the rotary table and the device 6 takes hold around the pipe and turns it to unscrew the threaded connection 4. During this movement, the pipe is held and lifted by the grab head in a way that will be described in greater detail below.

The grab 2 is articulated to the arm 3 and can be moved into various angular positions in opposition to a stabilizing damper 7. The arm is pivotally supported on a frame (not shown) which is movable up and down in two guides 8, only one of which may be seen in the drawing. The arm 3 can be rotated in the vertical plane by means of a cylinder 9. The entire frame and guides are rotatably mounted on a platform 10.

The grab head 2 will be described in greater detail with reference to FIGS. 3–6. The grab head 2 has an outer housing 11 consisting of a tubular jacket, preferably of quadratic cross section. At each respective end 12,13 of the housing 11, pivotable flaps or fingers 14,15 are arranged which can be rotated synchronously through the action of a pneumatic cylinder 16 on the flaps and on articulated arms 17 and the end 12 and two corresponding arms at the end 13 of the housing. The tubular housing 11 has an entry slot for the pipe 1, which is not visible in the drawing. When the head 2 has been guided into position around the pipe, the flaps or fingers 14,15 at each end of the housing 11 are pivoted into a restraining position to prevent the pipe from falling out of the grab and at the same centering the pipe within the grab head. The housing contains a rotatable, upper member 18 (FIGS. 4*a* and 4*b*). This member consists of a U-shaped body 19 having an entry slot 20 for the pipe. This member can be moved in the longitudinal direction of the housing 11 by means of four lifting cylinders 21, whose lower ends 22 are rigidly attached to the housing. The upper end of the cylinders is connected to a ring 23 that is rotatably mounted against another ring 24, which moves in guides 25 and is spring-loaded in a downward direction by means of springs 26. The member 19 is rotatably supported by a roller flange 27. On the member 19, specifically at the boundary walls defining the entry slot 20, two opposing, facing, inclined planes 28 are provided. Mounted on each of these is a wedge means 29 provided with a friction coating 30 and movable up and down along the inclined plane. When a pipe is guided into the opening 20, the springs 26 will exert pressure on the wedges 29 and force them into contact against the exterior of the inserted pipe. When the arm 3 is moved vertically upward, the weight of the length of pipe will cause the wedge members to become even more firmly clamped against the pipe, so that the arm 3 with the grab head 2 will securely hold and retain the pipe 1. The member 18 is provided with a downwardly facing inclined plane 32 wherein the entry and exit ends of the helix are connected by an inclined plane 33 extending at an acute angle relative to the centerline 34.

Fixedly connected to the housing is a lower claw-like member 35 having an entry slot 36 similar to the opening 20 in the member 18. The fixed member 35 has an upwardly facing inclined plane 37 which follows a helical path and is complementary to the surface 32 on the member 18. As on the member 18, the entry and exit ends of the helical plane 37 are connected by an inclined plane 38 which forms an acute angle relative to the centerline.

When a stand of pipe 1 has been positioned in the pipe rack and is to be released from the assembly, the upper member 18 is guided downwardly by supplying pressure to the cylinders 21. The member 18, owing to its own weight and with the aid of the springs 26, will then be guided down into the position shown in FIG. 3. The member 18, owing to its rotation, will have assumed an arbitrary angular position in relation to the member 35. It is necessary, however, that the respective pipe entry slots 20 and 36 on the respective members 18 and 35 be brought into alignment with each other. This happens automatically when the inclined planes 32 and 37 encounter each other. These planes will then slide in relation to each other until the surface 33 slides down along the surface 38, and the members 18 and 35 will be locked in this position. The cam member 35 is pulled up by the same cylinder that actuates the ring 23.

The weight compensating means for the drill pipe 1 can be made in several different ways. For example, the lifting action of the cylinder 9 can cause an adjustable and calculated lifting action on the end of the arm 3.

The assembly of the invention operates in the following manner: When the drill string 5 is to be withdrawn from the well, the hook on the derrick hoists the drill string up into a position wherein a stand of pipe 1 consisting of three lengths of pipe is situated above the rotary table.

The drill string is held and retained in this position, and the arm 3 is guided forward so that the grab head 2 surrounds the pipe. The wedges 29 are guided into contact for securely retaining the pipe in the grab head. The weight compensating means then comes into play, exerting an upwardly directed force on the grab head corresponding to the weight of the pipe 1. The stand of pipe is then rotated by the device 6 to unscrew the coupling 4. In the meantime the hook has been released and the hook and block guided downwardly toward the rotary table for retrieving and withdrawing a new length of pipe. It should be noted that when the screw connection between the stand of pipe 1 and the rest of the drill string is being disengaged, the stand of pipe 1 is weightless, thereby preventing unnecessary wear on the threads. After the pipe 1 has been detached from the rest of the drill string, the entire frame containing the arm 3 is raised by means of the cylinders 9' in FIG. 2 and the stand of pipe is transported to the rack in the usual way.

Having described my invention, I claim:

1. In a pipe handling assembly for use with a derrick having at least one pivotable and vertically movable arm: a pipe grab head connectable to the arm for movement therewith for transporting a vertical pipe from a well center to a rack and vice versa, said grab head comprising a support; an upper member carried by said support, said upper member having a laterally facing slot therein for receiving the pipe, said upper member having means for locking the pipe in said slot so as to permit said upper member to support the pipe; means mounting said upper member to said support for rotation about a vertical axis which corresponds to the axis of the pipe when locked in said slot whereby said upper member and the pipe can rotate together relative to said support; a lower member non-rotatably mounted to said support, said lower member having a laterally facing slot therein for receiving the pipe; and means for rotating said upper member from an arbitrary angular position to a position in which the slot therein is in alignment with the slot in said lower member and for locking said upper member in said position.

2. A pipe handling system as in claim 8 wherein said support comprises a vertical tubular housing in which said upper and lower members are mounted, said housing having a laterally facing opening extending the vertical length thereof and corresponding to the slot in said lower member for permitting insertion of the pipe into said housing and into said slot in said lower member.

3. A pipe handling system as in claim 2 wherein said housing includes, at each end, retaining means, engageable with and disengageable from an inserted pipe for preventing the inserted pipe from falling out of said housing and for centering the pipe within said housing.

4. A pipe handling assembly as in claim 3 wherein the preventing and centering means includes two facing, pivotable flaps, attached to the housing and pivotable about one end thereof by means of a power-driven actuator.

5. A pipe handling assembly as in claim 1 wherein said means for rotating the upper member is formed by facing surfaces on the upper and lower members, formed as complementary, helical inclined planes whose ends, which are the helix entrance and the helix exit, are connected via surfaces which form an acute angle relative to the housing centerline.

6. A pipe handling assembly as in claim 5 including, between the upper and lower members, a plurality of cylinders for lowering the helical surface of the lower member clear of the helical surface of the upper member to permit rotation of the upper member.

* * * * *